US006336475B2

(12) United States Patent
Dewispelaere et al.

(10) Patent No.: US 6,336,475 B2
(45) Date of Patent: Jan. 8, 2002

(54) METHOD FOR MANUFACTURING A PILE FABRIC WITH A HIGH FRAME COUNT

(75) Inventors: Andre Dewispelaere, Kortrijk/Marke; Ludo Smissaert, Assebroek, both of (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/774,596

(22) Filed: Feb. 1, 2001

(30) Foreign Application Priority Data

Feb. 2, 2000 (BE) ..... 2000/0087

(51) Int. Cl.[7] ..... D03D 27/00

(52) U.S. Cl. ..... 139/391; 139/392; 139/402; 139/408; 139/411

(58) Field of Search ..... 139/353 F, 391, 139/392, 394, 402, 408, 411

(56) References Cited

U.S. PATENT DOCUMENTS

| | | | | |
|---|---|---|---|---|
| 3,612,110 A | * | 10/1971 | Wildi | 139/383 |
| 5,431,786 A | * | 7/1995 | Rasch et al. | 162/348 |
| 6,012,083 A | * | 8/2000 | Vandoorne | 139/391 |
| 6,273,148 B1 | * | 8/2001 | Debaes et al. | 139/402 |

FOREIGN PATENT DOCUMENTS

| | | | |
|---|---|---|---|
| EP | 0534515 A1 * | 3/1993 | D03D/27/10 |
| EP | 0 628 649 | 12/1994 | |

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

Method for face-to-face weaving pile fabrics whereby warp yarns (1)–(15) of a series of warp yarn systems are interwoven with weft yarns (16), (17), (18) in order to weave a top (19) and a bottom backing fabric (20), whereby pile warp yarns (11)–(15) are alternately passed around a weft yarn (16), (18) of the top backing fabric (19) and the bottom backing fabric (20) so that they form pile, whereby per warp yarn system at least two non-pile-forming pile warp yarns (11)–(15) are inwoven in one and the same backing fabric (19), (20) and according to this invention are divided per warp yarn system into at least two groups each with at least one pile warp yarn, so that the weft yarns (11, 13), (12); (14), (15) of different groups extend respectively at a different level in the backing fabric, and whereby finally the pile-forming pile warp yarns are cut through between the two backing fabrics so that two fabrics are obtained.

A pile fabric whose non-pile-forming pile warp yarns (11)–(15) are per warp yarn system inwoven in the backing fabric (19), (20) in two layers located one above the other.

Especially with pile fabrics with high frame count because of this it is avoided that with a color transition in weft direction the pile loops are spread apart from each other by interjacent inwoven pile warp yarns.

12 Claims, 1 Drawing Sheet

METHOD FOR MANUFACTURING A PILE FABRIC WITH A HIGH FRAME COUNT

BACKGROUND OF THE INVENTION

This invention relates to a method for face-to-face weaving pile fabrics whereby warp yarns of a series of warp yarn systems are interwoven with weft yarns so that a top and a bottom backing fabric are formed, whereby pile warp yarns are alternately passed around a weft yarn of the top backing fabric and around a weft yarn of the bottom backing fabric so that they form pile, while per warp yarn system at least two non-pile-forming pile warp yarns are inwoven in one and the same backing fabric, and whereby the pile-forming pile warp yarns are split between the two backing fabrics so that two fabrics are obtained.

This invention also relates to a pile fabric comprising a backing fabric woven out of weft yarns and warp yarns, a number of pile yarn loops passed around weft yarns of the backing fabric and pile warp yarns inwoven in the backing fabric, and more especially such a pile fabric that is woven according to the method according to this invention.

The above described known method can be implemented on a known weaving machine which is provided for inserting one or several weft yarns between warp yarns in the course of successive weft insertion cycles. These warp yarns are for that purpose positioned in relation to the weft insertion levels by means of a shed-forming device.

The warp yarns are provided in a series of warp yarn systems located next to one another, and the warp yarns of each warp yarn system are pulled through a respective space between reed dents. Per warp yarn system several pile warp yarns are provided, for example in order to allow differently colored pile warp yarns alternately to form pile and be inwoven in accordance with a predetermined pattern, so that the differently colored pile loops of the fabric form the pattern.

The demand for pile fabrics with a wide color variation is increasing and the development of such fabrics is becoming evermore easy by the use of CAD systems and electronic jacquard machines. For this purpose per warp yarn system a large number of differently colored pile warp yarns must be provided. If the number of pile warp yarns per warp yarn system, also called "the number of pile frames per reed space", is high (for example 6 or higher) they are called pile fabrics with high frame count. In each warp yarn system there are a number of pile warp yarns that form no pile and are burried in one of the backing fabrics. It is usual to divide these non-pile-forming pile warp yarns between the top and the bottom backing fabric for their inweaving. As long as the number of pile warp yarns per fabric to be inwoven remains limited, pile fabrics of a high quality can be woven in the known manner. But with pile fabrics with high frame count, drawback effects occur with color transitions in weft direction. If namely in two warp adjacent yarn systems with several different pile warp yarns provided next to one another in a specific sequence a pile warp yarn of different frame has to form pile, it is possible that a large number of inwoven pile warp yarns extend between the two pile-forming pile warp yarns running next to one another and push apart the pile loops formed by these pile warp yarns. Because of this with a number of color transitions in weft direction a line becomes visible extending in warp direction. Such a fabric is clearly of a lesser quality.

In order to remedy for this drawback a number of measures have been put forward in the Belgian patent application no. 9700712. These measures reduce the drawback effects with color transitions in weft direction but appear in general, and especially with fabrics where a frame count of 8 or more is used per warp yarn system, insufficient for obtaining fabrics of a perfect quality.

SUMMARY OF THE INVENTION

The purpose of this invention is on the one hand to provide a face-to-face weaving method that enables pile fabric weaving of a perfect quality, and this not only where the frame count per reed space is relatively low (at least two), but also where this frame count is particularly high (e.g. 12, 14 or more), and on the other hand to provide a pile fabric with such properties that the quality thereof is independent of the frame count per reed space, in contrary to the known pile fabrics.

These objectives are achieved according to this invention by means of a method with the characteristics mentioned in the first paragraph of this specification, whereby the aforesaid non-pile-forming pile warp yarns are divided per warp yarn system into at least two groups each with at least one pile warp yarn, and whereby the pile warp yarns of the different groups extend respectively at a different level in the same backing fabric, and by providing a pile fabric comprising a backing fabric woven out of weft yarns and warp yarns, a number of pile yarn loops passed around weft yarns of the backing fabric and pile warp yarns inwoven in the backing fabric, of which the inwoven pile warp yarns divided between at least two layers located one above the other are inwoven in the backing fabric.

Because of the fact that the inwoven pile warp yarns are divided per warp yarn system between two layers located one above the other a series of inwoven pile warp yarns between two pile loop rows no longer occupy such a large width as with fabrics that are woven according to the known weaving methods. Because of this the pile loops are not spread apart and the drawback effect of line formation is prevented, in pile fabrics with high frame count.

According to a preferred method according to this invention the pile warp yarns of different groups inwoven in the same backing fabric are separated from each other by weft yarns of the backing fabric.

This method according to the invention is preferably so implemented that each group comprises at least two pile warp yarns.

It is furthermore also preferable in each warp yarn system per group of pile warp yarns to inweave a tension warp yarn adjacent to these pile warp yarns.

According to a particularly efficient method in each backing fabric weft yarns are inwoven at three different levels, namely a pile side level, a middle level and a back level, and in each backing fabric per warp yarn system a first and a second group of pile warp yarns are inwoven, respectively running along the pile side and along the backside of the middle level weft yarns.

This method can also be so applied that the pile warp yarns of the first group run between the weft yarns of the pile side level and the weft yarns of the middle level, while pile warp yarns of the second group run between the weft yarns of the middle level and the weft yarns of the back level.

The pile warp yarns of the first group can also be undulatingly inwoven, whereby in each warp yarn system they alternately run along the pile side in relation to a weft yarn of the pile side level and between a weft yarn of the pile side level and a weft yarn of the middle level.

The most preferred is the method according to this invention whereby in each backing fabric alternately two weft yarns one above the other and one single weft yarn are inwoven, whereby the two weft yarns inwoven one above the other are inwoven in the backing fabric respectively at the middle level and at the back level, and whereby the single weft yarns are inwoven in the backing fabric at the pile side level.

The non-pile-forming pile warp yarns are moreover preferably also inwoven divided per warp yarn system between the top and the bottom backing fabric.

This method has the greatest productivity if it is utilized on a weaving machine with weft insertion means that are provided for inserting simultaneous three weft yarns between warp yarns per weft insertion cycle.

According to another particular property of the method according to this invention in each backing fabric a first, a second and a third binding warp yarn is provided per warp yarn system, so that the first and the second binding warp yarn cross each other repeatedly and an opening is formed in each case between every two successive intersections, through which two weft yarns extend one above the other, and so that the third binding warp yarn runs alternately along the pile side in relation to a weft yarn of the pile side level and along the back in relation to a weft yarn of the middle level.

A pile fabric, comprising a backing fabric woven out of weft yarns and warp yarns, a number pile yarn loops passed around weft yarns of the backing fabric and pile warp yarns inwoven in the backing fabric, of which the inwoven pile warp yarns are inwoven divided between at least two layers located one above the other in the backing fabric, is another object of this invention. The quality of such a fabric is perfect, even if the warp yarn systems comprise a large number of pile warp yarns. In pile fabrics with high frame count and with color transitions in weft direction no trouble lines are formed any longer.

With such a pile fabric the pile warp yarns of different layers can be separated from each other by interjacent weft yarns, and the inwoven pile warp yarns can be divided per warp yarn system between the aforesaid layers while in each warp yarn system a tension warp yarn is married to each layer of pile warp yarns.

Furthermore each pile fabric that is manufactured according to the method according to this invention is of course also a pile fabric according to this invention.

The characteristics and advantages of this invention are further explained on the basis of the following detailed specification of a possible method according to this invention and of the fabric manufactured according to this method. This specification is only given by way of example and can consequently in no way be interpreted as a restriction on the scope of the protection claimed for this invention in the claims of this patent application.

In this specification reference is made to the drawing attached hereto,

DETAILED DESCRIPTION

Figure 1:
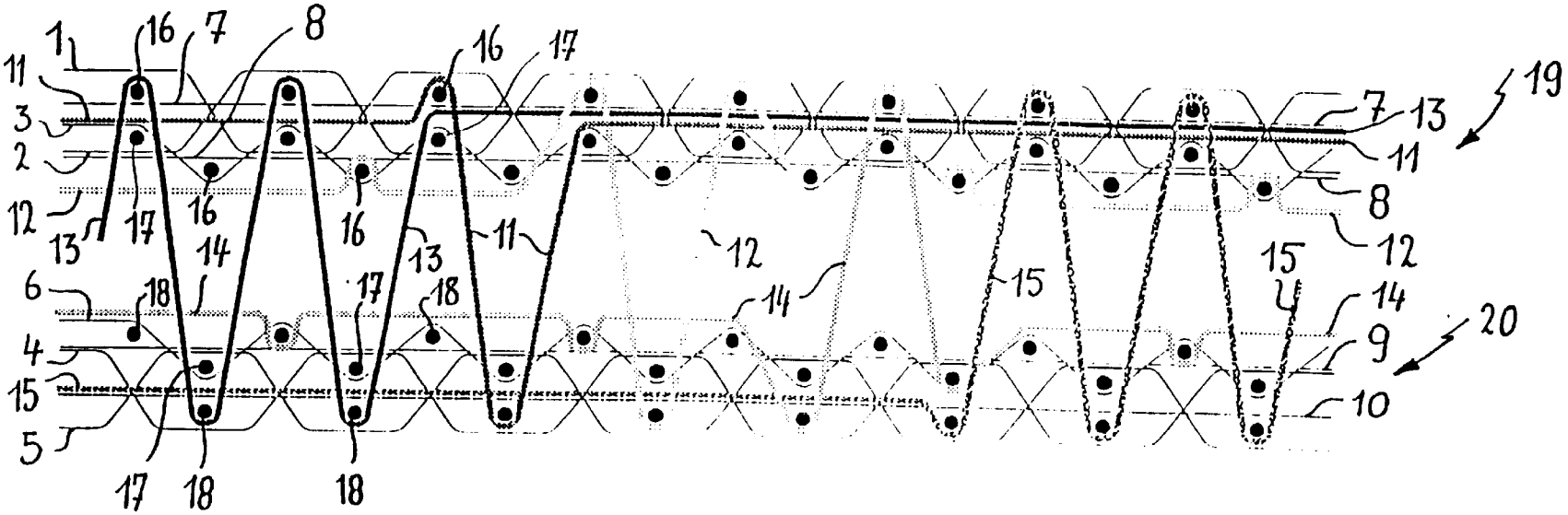
FIG. 1, which represents a schematic cross-section in warp direction of a face-to-face fabric, in the course of the weaving thereof on a face-to-face weaving machine according to a method according to this invention.

On a known three-rapier face-to-face weaving machine provided with a four-position open-shed jacquard machine a series of warp yarn systems is provided next to one another. Each warp yarn system comprises six binding warp yarns (1), (2), (3), (4), (5), (6), four tension warp yarns (7), (8), (9), (10), and five pile warp yarns (11), (12), (13), (14), (15) of different colors.

The rapiers of the weaving machine are operated in order in the course of successive weft insertion cycles in each case to insert a top weft yarn (16), a middle weft yarn (17) and a bottom weft yarn (18) one above the other between the warp yarns (1)–(15).

Prior to each weft insertion the pile warp yarns are brought by the jacquard machine and the backing warp yarns by a cam disks or dobby to the correct height in relation to the weft insertion levels in order to obtain two backing fabrics (19), (20) through the interweaving of weft yarns (16), (17), (18) with binding warp yarns (1), (2), (3); (4), (5), (6) and tension warp yarns (7), (8); (9), (10), and in order to enable the pile warp yarns (11)–(15) to form pile in specific places and to inweave in the fabric in other places so that through the different colors of the pile loops a specific pattern is formed according to a predetermined pattern design.

In the course of a first operating cycle the warp yarns (1)–(15) of the various warp yarn systems are so positioned that the top (16) and the middle weft yarn (17) are inwoven one above the other in the top backing fabric (19) by binding warp yarns (1), (2), (3) while the bottom weft yarn (18) is inwoven in the bottom backing fabric (20) by binding warp yarns (4), (5), (6). In the course of a second operating cycle the warp yarns are so positioned that only the top weft yarn (16) is inwoven in the top backing fabric (19) by the binding warp yarns (1), (2), (3), while the middle (17) and the bottom weft yarn (18) are inwoven one above the other in the bottom backing fabric (20) by the binding warp yarns (4), (5), (6).

These first and second operating cycles are utilized alternately so that two backing fabrics (19), (20) are woven in which alternately (in warp direction) two weft yarns (16), (17); (17), (18) one above the other and one single weft yarn (16); (18) are inwoven by binding warp yarns (1)–(3); (4)–(6).

In each backing fabric (19), (20) the weft yarns (16), (17), (18) are inwoven at three different levels: a back level, a middle level and a pile side level.

In each backing fabric (19), (20) two tension warp yarns (7), (8); (9), (10) are inwoven per warp yarn system. One tension warp yarn (7), (10) extends between the weft yarns (16), (17); (17), (18) inwoven one above the other, while the other tension warp yarn (8), (9) extends between the weft yarns (16), (18) of the pile side level and the weft yarns (17) of the middle level.

The pile warp yarns (11), (12), (13), (14), (15) are in the course of the successive operating cycles positioned in order either to form pile or to be inwoven in one of the backing fabrics (19), (20), so that the various pile-forming pile warp yarns of the fabric form pile loops which through the mutual color differences make a figure or a specific pattern visible in the fabric.

If the pile warp yarns do not form pile they are inwoven in the backing fabrics (19), (20). Two pile warp yarns (14), (15) are inwoven in the bottom backing fabric (20) if they do not form pile. The three other pile warp yarns (11), (12), (13) are inwoven in the top backing fabric (19) if they do not form pile.

In each backing fabric (19), (20) the inwoven pile warp yarns are divided between two layers located one above the other. The pile warp yarns of one layer extend between the weft yarns (16), (17); (17), (18) inwoven one above the other, while the pile warp yarns of the other layer are undulatingly inwoven and run alternately above and below a weft yarn (16), (18) of the pile side level. In each warp yarn system the inwoven pile warp yarns of one layer are therefore married to a tension warp yarn (7), (10).

Per warp yarn system three binding warp yarns (1), (2), (3); (4), (5), (6) are provided for each backing fabric (19), (20). For each backing fabric a first (1), (4) and a second binding warp yarn (2), (5) are so positioned in each operating cycle that they cross each other repeatedly, whereby in each case an opening is formed between two successive intersections, and that the successive weft yarns (16), (17); (17), (18) provided one above the other extend through these openings. For each backing fabric (19), (20) a third binding warp yarn (3), (6) is furthermore also so positioned that it runs alternately along the pile side in relation to a weft yarn (16), (18) of the pile side level and along the back in relation to a weft yarn (17) of the middle level.

The above described method has been specified for only five pile warp yarns per warp yarn system. This invention is especially, though not exclusively, applicable to manufacturing pile fabrics with a greater number of pile warp yarns or frame count. Thus according to this method a 14 frame count pile fabric can for example be woven, whereby in each backing fabric and per warp yarn system a first layer with four inwoven pile warp yarns and a second layer with three inwoven pile warp yarns is formed. The layer with four pile warp yarns preferably extends between the weft yarns (16), (17); (17), (18) inserted one above the other. The pile fabric can also be woven with four (instead of six) binding warp yarns per warp yarn system, so that in each backing fabric two binding warp yarns cross each other repeatedly and so that in the successive openings between their intersections in each case two weft yarns (16), (17); (17), (18) inwoven one above the other, as well as one single weft yarn (16); (18) extend.

The pile fabric can also be woven with single, double or quadruple weft insertion means, whereby use is either made or not made of disengagement of one or several weft insertion means or whereby weft cancellation is utilized.

The known means for avoiding double-acting pile warp yarns or mixed contours can of course also be applicated with this weave.

We claim:

1. Method for face-to-face weaving pile fabrics whereby warp yarns (1)–(15) of a series of warp yarn systems are interwoven with weft yarns (16), (17), (18) so that a top (19) and a bottom backing fabric (20) are formed, whereby pile warp yarns (11)–(15) are alternately passed around a weft yarn (16) of the top backing fabric (19) and around a weft yarn (18) of the bottom backing fabric (20) so that they form pile, while per warp yarn system at least two non-pile-forming pile warp yarns (11), (12), (13; (14), (15) are inwoven in one and the same backing fabric (19); (20), and whereby the pile-forming pile warp yarns (11)–(15) are split between the two backing fabrics so that two fabrics are obtained, characterized in that the aforesaid non-pile-forming pile warp yarns (11)–(15) are divided per warp yarn system into at least two groups each with at least one pile warp yarn (11, 13), (12); (14), (15), and that the pile warp yarns of the different groups extend respectively at a different level in the same backing fabric (19), (20); and that the pile warp yarns (11, 13), (12); (14), (15) of different groups inwoven in the same backing fabric are separated from each other by weft yarns (17) of the backing fabric.

2. Method for face-to-face weaving pile fabrics according to claim 1 characterized in that each group (11, 13), (12); (14), (15) comprises at least two pile warp yarns.

3. Method for face-to-face weaving pile fabrics according claim 1 characterized in that in each warp yarn system per group of pile warp yarns (11, 13), (12); (14), (15) a tension warp yarn (7), (8), (9), (10) is inwoven adjacent to these pile warp yarns.

4. Method for face-to-face weaving pile fabrics according to claim 1 characterized in that in each backing fabric (19), (20) weft yarns (16), (17), (18) are inwoven at three different levels, namely a pile side level, a middle level and a back level, and that in each backing fabric per warp yarn system a first (12), (14) and a second group of pile warp yarns (11, 13), (15) are inwoven, respectively running along the pile side and along the backside of the weft yarns (17) of the middle level.

5. Method for face-to-face weaving pile fabrics according to claim 4 characterized in that the pile warp yarns (12), (14) of the first group run between the weft yarns (16), (18) of the pile side level and the weft yarns (17) of the middle level, and that the pile warp yarns (11, 13), (15) of the second group run between the weft yarns (17) of the middle level and the weft yarns (16), (18) of the back level.

6. Method for face-to-face weaving pile fabrics according to claim 4 characterized in that the pile warp yarns (12), (14) of the first group are undulatingly inwoven, whereby they alternately run along the pile side in relation to a weft yarn (16), (18) of the pile side level and between a weft yarn (16), (18) of the pile side level and a weft yarn (17) of the middle level.

7. Method for face-to-face weaving pile fabrics according to claim 4 characterized in that in each backing fabric (19), (20) alternately two weft yarns (16, 17), (17, 18) one above the other and one single weft yarn (16); (18) are inwoven, that the two weft yarns inwoven one above the other are inwoven in the backing fabric (19), (20) respectively at the middle level and at the back level, and that the single weft yarns (16), (18) are inwoven in the backing fabric at the pile side level.

8. Method for face-to-face weaving pile fabrics according to claim 1 characterized in that the non-pile-forming pile warp yarns (11)–(15) are inwoven divided per warp yarn system between the top (19) and the bottom backing fabric (20).

9. Method for face-to-face weaving pile fabrics according to any of the preceding claims characterized in that it is utilized on a weaving machine with weft insertion means that are provided for inserting three weft yarns (16), (17), (18) between warp yarns per weft insertion cycle.

10. Method for face-to-face weaving pile fabrics according to one of the claim 7 characterized in that in each backing fabric (19), (20) a first (1), (4), a second (2), (5) and a third binding warp yarn (3), (6) is provided per warp yarn system, so that the first (1), (4) and the second binding warp yarn (2), (5) cross each other repeatedly and an opening is formed in each case between every two successive intersections, through which two weft yarns (16), (17); (17), (18) extend one above the other, and so that the third binding warp yarn (3), (6) runs alternately along the pile side in relation to a weft yarn (16), (18) of the pile side level and along the back in relation to a weft yarn (17) of the middle level.

11. A pile fabric, comprising a backing fabric (19), (20); and that the pile warp yarns (11)–(15) of different layers are separated from each other by interjacent weft yarns (17) woven out of weft yarns (16), (17), (18) and warp yarns (1)–(15), a number of pile yarn loops passed around weft yarns of the backing fabric and pile warp yarns (11)–(15) inwoven in the backing fabric characterized in that the inwoven pile warp yarns are inwoven divided between at least two layers located one above the other in the backing fabric (19), (20).

12. A pile fabric according to claim 11 characterized in that the inwoven pile warp yarns (11)–(15) are divided per warp yarn system between the aforesaid layers and that in each warp yarn system a tension warp yarn (7), (8), (9), (10) is married to each layer of pile warp yarns.

* * * * *